United States Patent [19]

McGraner

[11] 4,274,538

[45] Jun. 23, 1981

[54] PACKAGE AND METHOD OF PACKAGING FOR FLAT ELONGATED MATERIAL

[75] Inventor: James E. McGraner, Columbus, Ohio

[73] Assignee: The Goodyear Tire & Rubber Company, Akron, Ohio

[21] Appl. No.: 95,198

[22] Filed: Nov. 19, 1979

[51] Int. Cl.[3] ..... B65D 85/671; B65H 75/25

[52] U.S. Cl. ..... 206/394; 206/398; 242/55.3; 242/105

[58] Field of Search ..... 206/389, 391, 394, 398, 206/53, 54, 408, 413, 415, 416; 242/55.3, 74, 105

[56] References Cited

U.S. PATENT DOCUMENTS

| | | | |
|---|---|---|---|
| 869,699 | 10/1907 | Follansbee | 206/413 |
| 932,808 | 8/1909 | Pelton | 206/415 |
| 1,239,082 | 9/1917 | Cary | 242/105 |
| 2,160,235 | 5/1939 | Slusar | 206/394 |
| 2,338,930 | 1/1944 | Gordon | 206/394 |
| 2,347,552 | 4/1944 | Gerrand | 242/105 |
| 3,281,033 | 10/1966 | Stutzman et al. | 206/394 |
| 3,381,812 | 5/1968 | Cohen | 206/398 |
| 3,777,905 | 12/1973 | Morris | 206/394 |
| 3,944,157 | 3/1976 | Kessler | 206/408 |
| 3,981,400 | 9/1976 | Quintana | 206/408 |

*Primary Examiner*—Joseph Man-Fu Moy
*Attorney, Agent, or Firm*—D. M. Ronyak

[57] ABSTRACT

A method and a package are described for the takeup, shipment, storage and individual dispensing of a plurality of rolls of flat elongated material, for example, conveyor belting. The package includes a plurality of side-by-side rolls of flat elongated material, each roll being wound on its own shell. Between each pair of shells there is provided a pair of divider plates. The divider plates are joined at their radially outermost ends to an upper frame member. The upper frame member is joined to a pair of side members which are joined to the outer ends of the assembled shells and to a central member which extends axially through the assembled shells. At least two ⊔-shaped tie members are provided which extend axially across the rolls and are joined at their radially inner ends to the outer ends of the assembled shells. Methods assembling and dissembling the package are also described.

8 Claims, 8 Drawing Figures

PACKAGE AND METHOD OF PACKAGING FOR FLAT ELONGATED MATERIAL

The abstract is not to be taken as limiting the invention of this application and in order to understand the full nature and extent of the technical disclosure of this application reference must be made to the accompanying drawings and the following detailed description.

This application pertains to a package for a plurality of side-by-side rolls of flat, elongated material and particularly to a package for the winding, shipment, storage and individual dispensing of at least two side-by-side lengths of flat belting.

While flat belting is used herein to describe the invention, it is to be understood that the invention is also applicable to conveyor belting, elastomeric sheet material such as is used for gaskets and tank linings and general trade use, and films and other sheet material.

At times it is desired to transport large diameter rolls of flat belting, the belting being of relatively narrow width. As an example, a roll of conveyor belting may be ten or more feet in diameter and only two feet in width. Such a roll is typically prepared for shipment by winding the roll on a central shell of wood or metal and building a crate around the roll in the configuration of the roll. The crate has two circular end plates of wood with the end plates at their outer periphery being joined to one another by boards extending parallel to the axis of rotation of the central shell about which the roll has been wound. This known packaging method is expensive in terms of man hours to assemble it and the amount of lumber required.

After the roll of belting has been crated as described it is typically placed with its axis of rotation extending horizontally upon a low-boy truck or a rail car and blocked to prevent rolling and tied down to prevent tipping over onto one of its sides. The radius of the roll of flat belting which can be accommodated in one roll is usually limited by the maximum clearances available on the proposed transportation route for the belting from its point of manufacture to its point of use. The wooden crating method just described adds somewhat to the overall height of the package and thus reduces the maximum amount of belting which could be supplied in a single roll if the belting itself were resting on the transporter and exposed at its highest point above the transporter. When the crated belt rolls are transported by rail car and these are sorted out in a railway freight yard the cars are caused to collide with one another to lock their couplings. The resulting impact has on occasion destroyed the wooden crate surrounding the roll of belting causing loss of time and/or damage to the belting.

A tall roll of relatively narrow belting, for example, a roll of about ten feet diameter and two to three feet in width, when positioned with its axis of rotation horizontal is relatively unstable and because of its great mass can pose a considerable threat to the safety of personnel. Packaging two or more of such tall narrow rolls side by side to one another provides a more stable package. The package of this invention can be used to wind, transport and dispense a plurality of side-by-side rolls of flat belting or other sheet material.

It is an object of an aspect of this invention to provide a package for the winding, shipment, storage and individual dispensing of at least two side-by-side rolls of flat belting.

The package is comprised of two cylindrical shells, each of the shells having a central bore extending axially therethrough, and a divider plate rigidly joined to one end of the shell. The divider plate extends radially outwardly beyond the circumference of any of said shells. The shells are positioned end-to-end with their bores aligned and the divider plates adjacent to and aligned with one another to form a pair of parallel plates having axially adjacent and axially most distant parallel surfaces. An elongated central member passes through the aligned central bores of said end-to-end shells and extends axially beyond the outer ends of said assembled shells. An upper frame member extends axially and generally horizontally beyond the outer ends of said assembled shells. A side member of the frame is rigidly attached to and depends from each end of the upper member. Each side member at its radially inner end is rigidly joined to the central member and to the outer end of the respective outer shell to prevent relative axial movement of the shells and central member. At least two tie members are spaced substantially equally apart from one another and from the upper member of the frame in the circumferential direction of the shells. Each of the tie members has a portion spaced a predetermined amount radially outwardly from the outer circumference of said shells. Each tie member extends axially beyond the assembled shells. Each of said tie members also includes a portion extending radially inwardly from each end of the axial portion of each tie member which overlies a part of an outer end of one of the assembled shells. The radial portion of each tie member is rigidly joined to a respective one of the outer shell ends and of one of the axial portions of the tie member. A bifurcated member whose legs extend to right angles of one another is used to join the radially inwardly facing surface of the upper member to one of the axially most distant surfaces of each pair of parallel divider plates. Preferably a plurality of tie bolts extend through the assembled shells to bind the shells together along their common horizontal axis. The nuts at the end of the tie bolts are preferably tack welded after tightening to prevent their becoming loose. To maximize rigidity of the joints between the various members of the package, these joints are preferably of welded construction.

According to another aspect of the invention there is provided a method of packaging for shipment and individual letoff of a plurality of side-by-side lengths of flat belting wound to form side-by-side rolls of a predetermined radius comprising (a) assembling in end-to-end relation on a common horizontal axis a plurality of cylindrical shells the adjacent ends of different ones of said shells each having a separate divider plate welded thereto, the divider plates being aligned with and parallel to one another to form at least one pair, each divider plate extending radially outwardly an equal amount beyond the circumference of the shells, said shells each having a central bore extending coaxially therethrough with an elongated member passing through the aligned central bores of said assembled shells;

(b) rotating the assembled shells about their common horizontal axis and winding a length of flat belting on each shell to form a roll of predetermined radius on each shell;

(c) welding each end of an axially extending upper member whose length is at least that of said end-to-end assembled shells to the radially outer end of a side member and welding the radially inner end of each side member to both the elongated central member and an outer end of an outer shell, the length of each side member being sufficient to extend from said upper member radially inwardly to said central member, the distance from the axis of rotation of the package to said upper member being greater than said predetermined radius;

(d) forming at least two ⊔-shaped tie members the bottom portion of each tie member being of a length slightly exceeding that of said end-to-end assembled shells, the side portions of said tie members being of a length slightly less than said predetermined radius;

(e) positioning each tie member with the bottom portion thereof extending axially and at said predetermined radius from the axis of rotation of the package and with the side portions of each tie member extending radially inwardly from said bottom portion and overlying the respective outer ends of the assembled shells, the tie members being spaced substantially equally apart from one another and said upper member in the circumferential direction of said shells;

(f) welding each side portion of each tie member at its radially inner end to the respective outer end of the assembled shells; and (g) welding a plurality of bifurcated members to said upper member and said divider plates, each of said bifurcated members having one leg extending axially along a radially inner surface of said upper member and another leg extending radially inwardly along one of the axially most distant surfaces of a pair of adjacent divider plates.

According to yet another aspect of the invention, the package just described may be separated into a number of smaller units corresponding to the number of shells in the package by (a) cutting and removing the axially extending portion of each tie member, (b) cutting the upper member at planes which intersect the axis of rotation of the package between each pair of divider plates, and (c) cutting the side members parallel to the axis of rotation of the package at their junction with the central member leaving the side members joined to the respective outer ends of the outer shells, and if present, cutting and removing the tie bolts which bind the shells together on a common axis.

Other features and advantages of the invention will become apparent as the description proceeds by having reference to the following drawings in which FIG. 1 is a front elevational view of a package according to the invention for shipment of three rolls of flat belting in side-by-side relationship;

Figure 1:
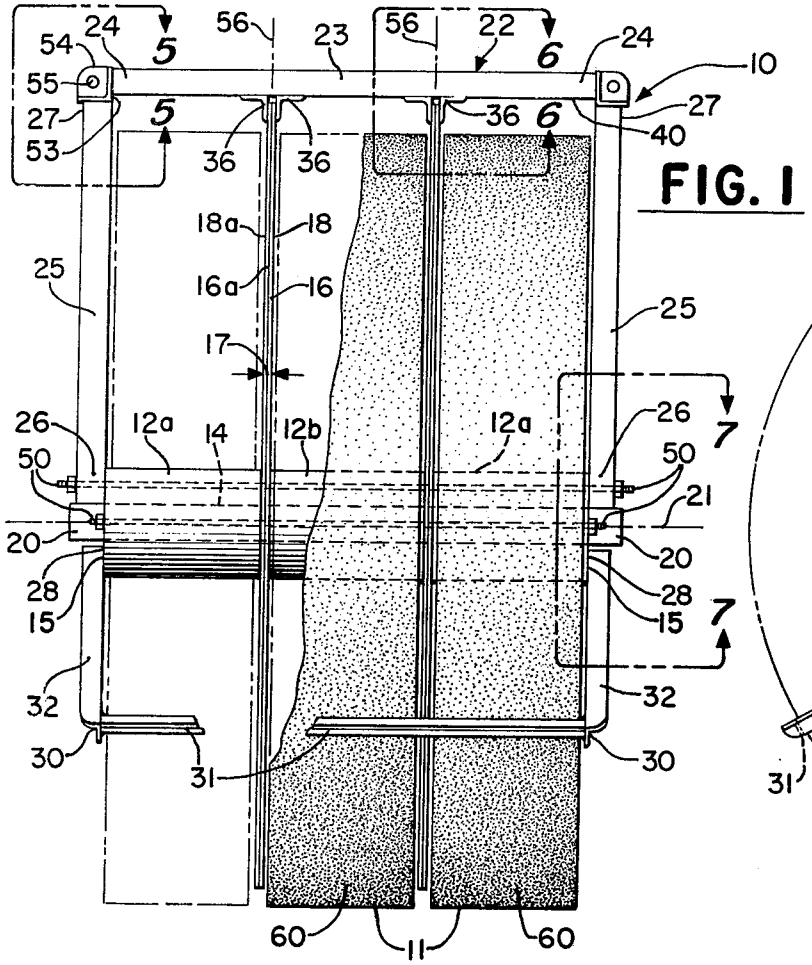
Figure 5B:
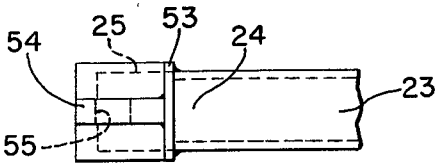
Figure 6:
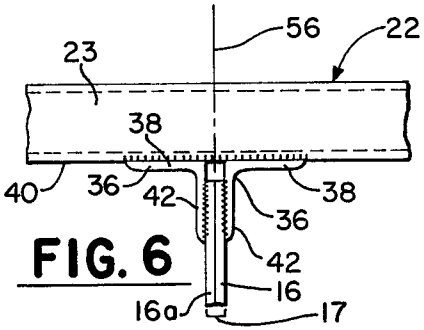
Figure 7:
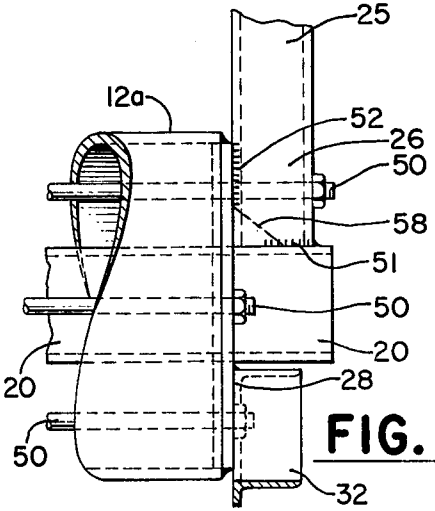
Figure 5A:
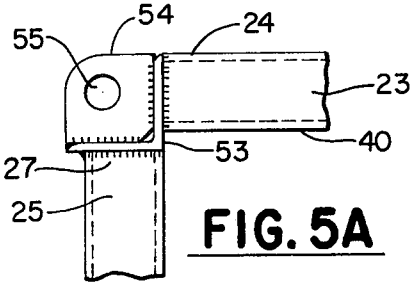

FIGS. 5*a* and 5*b* are enlarged front and top views obtained by sectioning FIG. 1 along line 5—5;

FIG. 6 is an enlarged frontal view taken along line 6—6 of FIG. 1; and FIG. 7 is an enlarged frontal view taken along line 7—7 of FIG. 1.

Figure 2:
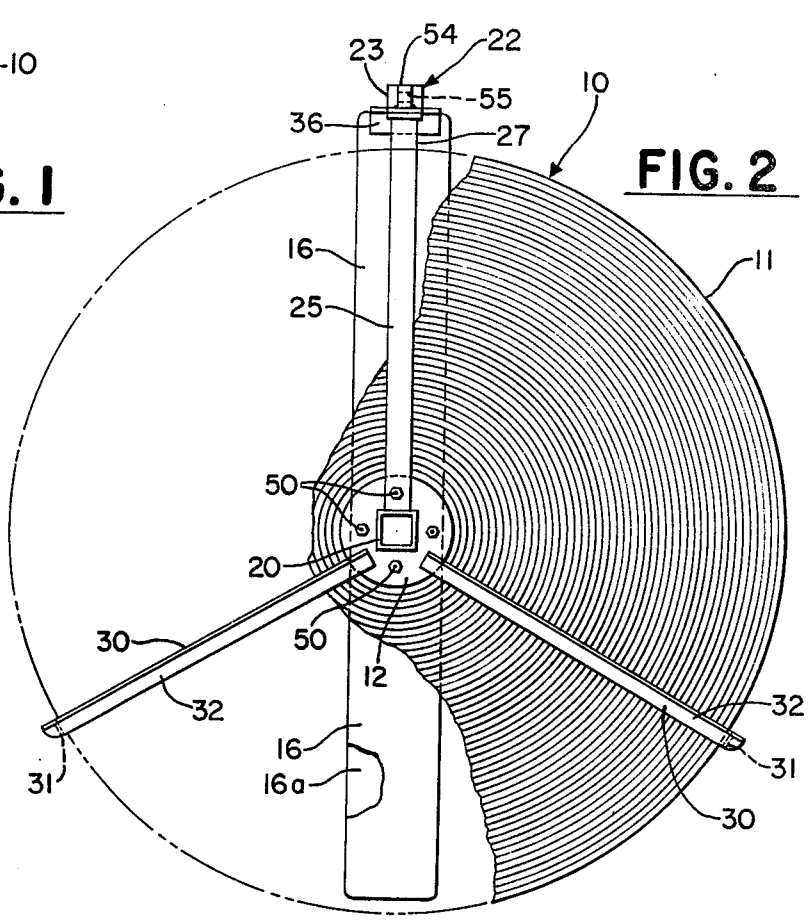
FIG. 2 is a side elevational view of the package shown in FIG. 1.
Figure 3:
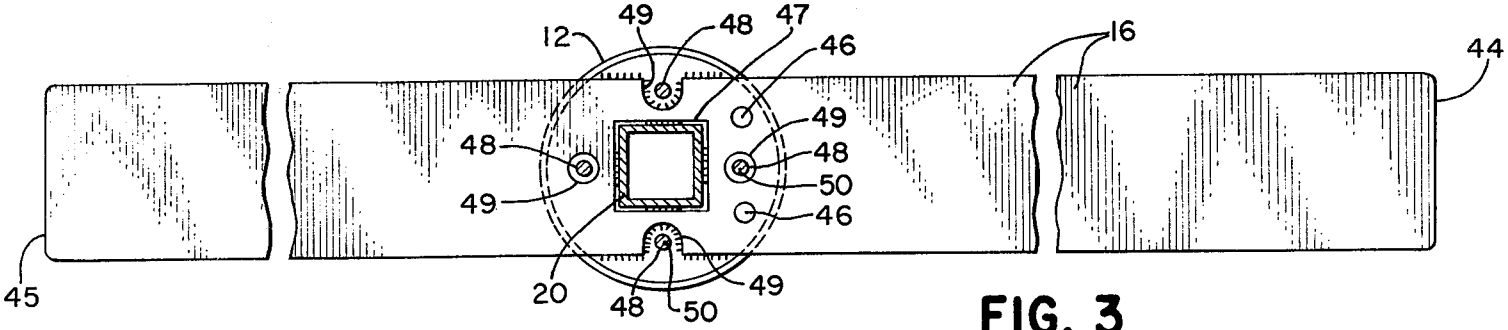
FIG. 3 is an end view of a shell and divider plate for use in a package according to the invention.

Referring to FIGS. 1 and 2 there is shown an assembled package 10 according to the invention suitable for shipment of three side-by-side rolls 60 of flat sheet material such as conveyor belting 11. The package includes three shells 12 including outer shells 12*a* and central shell 12*b* which are assembled end-to-end on a common axis of rotation 21 for the package 10. Each of the shells 12*a*, 12*b* has a central bore 14 extending axially therethrough which preferably is of square cross-sectional configuration. An elongated central member 20 extends through the aligned central bores 14 of the shells 12*a* and 12*b*. The elongated central member 20 is of sufficient length to extend axially beyond the outer ends 28 of the outer shells 12*a*. Preferably the central member 20 is a heavy walled steel tube of square cross-section. The shells 12*a* and 12*b* are preferably formed by taking heavy walled cylindrical portions and welding to the ends thereof heavy circular flat plate members. For example, to manufacture an 18 inch diameter shell the cylindrical portion of the shell may be formed of schedule 40 steel pipe and the end plates 15 of each shell may be formed of one inch thick steel plate; the steel end plates being welded to the cylindrical portion of the shell 12*a*, 12*b*. At one end of each outer shell 12*a* there is provided a divider plate 16 of steel which extends radially outwardly beyond the circumference of the shell an amount determined by the radius of the belt roll to be formed on the respective shell. As seen in FIGS. 1, 2 and 3 the divider plate 16 is preferably an elongated member having a length much greater than its width and having a larger portion 44 which extends radially outwardly from the shell 12 very nearly to the upper horizontal member 23 of the frame. The smaller portion 45 of each divider plate 16 extends radially outwardly from its respective shell an amount slightly less than the predetermined roll diameter for which the package 10 is designed. Each divider plate 16 includes clearance holes or recesses 49 for acceptance of tie bolts 50 which are to be passed through the assembled shells to draw them together along their common longitudinal axis and hole 47 for passage of the central member 20 therebetween. Of course, the divider plates 16 could also be discs. The end plates 15 of the shells 12 include tie bolt holes 48 for passage of the tie bolts 50 axially therethrough. Two close tolerance holes 46 are provided in divider plate 16 for alignment purposes prior to welding of said divider plate to end plate 15 of shell. Alignment of divider plate 16 is achieved by bolting said plate to shell end plate 15 which has correspondingly located tapped holes within. After welding the two temporary aligning bolts are removed.

When used in this specification "axially" and its related forms means in the direction of or parallel to the axis of rotation of the shells of the package. In FIG. 1 numeral 21 indicates the axis of rotation of the shells 12 and/or package 10 and/or rolls 60.

"Radial" and related forms when used herein means in a direction that is perpendicular to and intersecting with the axis of rotation of the shells and/or package.

"Horizontal" and related forms as used herein means substantially perpendicular to the direction of gravitational pull and parallel to the plane of the horizon of the earth.

"Circumferentially" and related forms as used herein is to be taken with respect to the axis of rotation of any cylindrical shell of the package.

Each outer shell 12*a* has a divider plate 16 welded to one end 15 thereof. Each inner or central shell 12*b* has a divider plate 16 welded to each end 15 thereof. The bores 14 and 48 of each shell 12*a*, 12*b* are such that they may be aligned and when they are aligned the divider plates 16 are also aligned. The shells 12*a*, 12*b* including divider plates 16 are assembled with the divider plates 16 and the bores 14, and 48, and holes 46 aligned.

Figure 4:
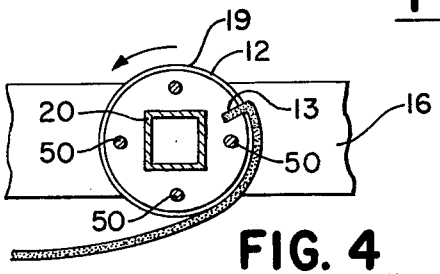
FIG. 4 is a fragmentary schematic view illustrating one method of starting a roll of flat belting material onto a shell of the package.

To facilitate starting a roll 60 of flat belting 11 on a shell 12*a* or 12*b*, the shell may be provided with a slot 13 extending axially across its outer circumferential surface 19. A tab is formed on the end of the belt or sheet material 11 and the tab is inserted into the slot 13 in the shell 12 and the shell is rotated to lock the tab into the shell slot. This is shown schematically in FIG. 4.

The package 10 includes a frame 22 including an upper member 23 which extends axially and generally horizontally an amount at least equal to the extent of the assembled end-to-end shells 12*a*, 12*b*. The upper member 23 is preferably made of tubular steel of square cross-section. Depending radially inwardly from each end 24 of the upper member 23 is a side member 25 which extends to the central member 20. The radially outer end 27 of each side member 25 is rigidly joined, preferably by welding, to the upper member 23 or gusset 53 which extends therebetween. A preferred manner of attachment is shown in FIGS. 5*a* and *b* where a short length of angular steel is used to form right angle gusset 53 with one leg of the gusset abutting and joined by weldment to an end 24 of the upper member 23 and the other leg of the right angle gusset 53 abutting and joined by weldment to the radially outer end 27 of side member 25. The right angle gusset 53 is further reinforced by a planar gusset 54 which is welded to both legs of the right angle gusset. Planar gusset 54 preferably includes an aperture 55 which is used in hoisting the assembled package 10.

The radially inner end 26 of each side member 25 is rigidly joined to central member 20 and to the outer end 28 of an outer shell 12*a*, preferably by welding. The preferred manner of extent of the weld 51 which joins side member 25 to central member 20 is shown in FIG. 7. It is to be noted that weld 51 does not extend axially inwardly the entire axial dimension or thickness of side member 25, that corner of side member 25 closest to the shell end 28 being free of weld. Also, weld 52 which joins side member 25 to the outer end 28 of the outer shell 12*a* does not extend radially inwardly from the outer circumference of the shell to the central member 20. The purpose and advantage of this arrangement will become apparent as the description proceeds. The radially inner end 26 of side member 25 may be truncated as shown by line 58 in FIG. 7 to encourage desired weld pattern.

The frame 22 also includes at least two ⊔-shaped tie members 30 which are spaced substantially equally apart in the circumferential direction of the shells 12 from one another and from the upper member 23. Each of the tie members 30 includes a cross portion 31 spaced radially from the axis 21 which extends axially an amount about equal to the combined axial dimension of the end-to-end assembled shells 12. Each tie member 30 also includes at each end thereof a side portion 32 which extends radially inwardly from each end of the axial portion 31 and overlies a part of the outer end 28 of an outer shell 12*a*. The radial portion 32 of each tie member 30 is rigidly joined to the bottom cross portion 31 of its respective tie member and is also rigidly joined to a respective one of the outer shell end 28, preferably by welding.

Referring to FIGS. 1 and 6, the frame 22 also includes a plurality of bifurcated members 36 whose legs 38,42 extend at right angles to one another. One leg 38 of each bifurcated member 36 extends axially and is rigidly joined to the radially inwardly facing surface 40 of the upper member 23 preferably by welding. The other leg 42 of each bifurcated member 36 extends radially inwardly and is rigidly joined to one of the axially most distant surfaces 18, 18*a* of a pair 17 of parallel divider plates 16, 16*a*.

The package 10 preferably further includes a plurality of tie bolts 50 which extend axially through the assembled shells 12*a*, 12*b*. These tie bolts 50 are used to draw the shells 12*a*, 12*b* tightly toward one another. The threaded nuts which are used to draw up the tie bolts 50 are preferably tack welded after cinching. A method of packaging for shipment and individual letoff of a plurality of side by side rolls 60 of flat belting 11 is as follows:

A plurality of cylindrical shells 12*a*, 12*b* are assembled in end-to-end relation on a common horizontal axis of rotation 21. Each of the adjacent ends of differing ones 12*a*, 12*b* of said shells has a separate divider plate 16 welded thereto. The divider plates are aligned with and parallel to one another as are the bores 48 and 14 which extend through each of the shells 12*a*, 12*b*. An elongated central member 20 is passed through the aligned central bores 14 of said end-to-end shells 12*a*, 12*b*. Tie-bolts 50 are used to draw the shells toward one another. One or more flat belts 11 are started onto the assembled shells 12 which are rotated about their common horizontal axis 21 to wind the side-by-side lengths of flat belting into side-by-side rolls 60 of a predetermined radius. After the rolls 60 are wound to their finished radius they may be banded or wrapped in known manner to secure them. The remainder of the package is then constructed. A pair of side members 25 are welded to the outer ends 28 of the outer shells 12*a* and to the central member 20 as shown in FIGS. 1 and 7. The side members 25 lie in a single radial plane. The radially outer end 27 of each side member 25 is then joined to an axially extending upper member 23 whose length is at least equal to the combined axial dimension of said end-to-end assembled shells and divider plates, preferably by welding. The side members 25 and upper member 23 are positioned circumferentially of the package 10 such that the upper member 23 extends across the divider plates 16 which when formed according to preferred embodiment of the invention include a larger portion 44 over which the upper member 23 extends. At least two ⊔-shaped tie members 30 are formed with the bottom or cross portion 31 of each ⊔-shaped tire member being of a length at least equal to the axial dimension of said assembled shells and with the side portions 32 of each of said tie members being of a length slightly less than the predetermined radius of the belt rolls. The bottom or cross portion 31 and side portions 32 of each tie member 30 are then positioned at a predetermined radius from the axis of rotation 21 of the package 10 with the side portions 32 of each tie member 30 extending radially inwardly from the bottom portion 31 of that tie member. The bottom portion 31 preferably is closely adjacent to or in contact with the rolls 60. Each side portion 32 of each tie member 30 overlies a respective outer end 28 of an outer shell 12*a*. The tie members 30 are preferably spaced substantially equally apart from one another and said upper member 23 when viewed in the circumferential direction of the shells 12*a*, 12*b*. In a preferred embodiment there is a single upper member 23 and two tie members 30 which are spaced 120 degrees apart from one another in the circumferential direction of the shells 12*a*, 12*b*. Each side portion 32 of each tie member 30 is preferably welded at its radially inner end to the respective outer end 28 of an outer shell 12*a*. Referring to FIGS. 1 and 2, redundant sharp corners of side portions 32 of tie member 30 at the juncture of said tie member and tie member 31 are preferably eliminated by radiusing. A plurality of bifurcated members 36 typically of angular steel are positioned such that one leg 38 of each extends radially along a radially inwardly facing surface 40 of the upper member 23 and the other leg 42 of each respective bifurcated member 36 extends radially inwardly along one of the axially most distant surfaces of a pair 17 of adjacent divider plates 16, 16*a*. Each leg of each bifurcated member 36 is preferably welded to the part it abuts.

When the package 10 including a plurality of side-by-side rolls 60 of conveyor belting 11 reaches its destination and it is desired to let off the rolls of belting individually the package is disassembled, preferably by cutting with an oxy-acetylene torch. It is understood, of course, that other known methods of severing such as sawing, grinding and chiseling may also be employed and the use of the term "cutting" is intended to contemplate these alternate methods. Because of the configuration of the package 10 this is readily accomplished. The tie-bolts 50, if present, are removed. The tie members 30 are burned apart and at least the bottom axially extending portion 31 of each tie member 30 is entirely removed. The upper horizontal member 23 of the frame 22 is burned apart at planes 56 as clearly shown in FIGS. 1 and 6. The side members 25 are separated from the central member 20 by burning apart welds 51. It is readily appreciated at this time that the extent of and positioning of welds 51 and 52 are such that separation of side member 25 from the central member 20 is readily accomplished since the weld 51 does not continue axially to the junction of the radially inner end 26 of the side member 25 with the outermost shell end 28. In like manner because divider plates 16 are assembled so as to form pairs 17 the upper member 23 is easily severed at lines 56. The result of this procedure is to dismantle the package 10 of FIG. 1 into three smaller sub-packages each of which includes an upper member (a portion of member 23) to facilitate hoisting and movement of that sub-package and mounting on a letoff unit. Because each shell 12*a*, 12*b* includes a central bore 14 therethrough a bar (not shown) may be inserted through bore 14 after which the remainder of upper member 23 is cut away from the sub-package. The roll 60 of belting may then be let off for use or installation.

The configuration of the package 10 allows the package to be rotated on a transporter such that the upper member 23 of frame 22 will be at an elevation equal to or less than that defined by the radius of the rolls 60 of belting. Referring to FIG. 2, it is readily apparent that the package 10 may be rotated either clockwise or counterclockwise to result in member 23 being at an elevation not exceeding that defined by the radius of the rolls 60 of belting. One of tie-members 30 may be used to help block the package 10 from rolling further. The configuration of the package 10 thus permits shipment of maximum diameter rolls of flat elongated material since the package 10, when properly positioned on the transporter, does not contribute to the overall height of the rolls 60.

While certain representative embodiments and details have been shown for the purpose of illustrating the invention it will be apparent to those skilled in the art that various changes and modifications may be made therein without departing from the spirit or scope of the invention.

I claim:

1. A package for winding, shipment, storage and individual dispensing of at least two side-by-side lengths of flat elongated sheet material comprising:

(a) two cylindrical outer shells each having a central bore extending axially therethrough, inner and outer ends, and a divider plate being rigidly joined to the inner end thereof, said divider plate extending radially outwardly beyond the circumference of said shells, said shells being positioned end-to-end, with their central bores aligned and their divider plates adjacent to and aligned with one another to form a pair of parallel plates having axially adjacent and axially most distant parallel surfaces;

(b) an elongated central member passing through the aligned central bores of said end-to-end shells, and extending axially beyond the outer ends of said end-to-end shells;

(c) a frame including an upper member extending axially and generally horizontally an amount about equal to the combined axial dimension of said end-to-end shells;

(d) a side member rigidly joined with and depending from each end of said upper member, each side member having its radially inner end rigidly joined to said central member and the outer end of the respective shell to prevent axial movement of said shells with respect to said central member;

(e) at least two tie members spaced substantially equally apart in the circumferential direction of said shells from one another and from said upper member, said tie members each having a portion spaced radially outwardly from the outer circumference of said shells and extending axially an amount about equal to the combined axial dimension of said end-to-end shells; said tie members each having a portion extending radially inwardly from each end of said axial portion and overlying part of an outer end of said end-to-end shells, each said radial portion being rigidly joined to a respective one of said axial portions and a respective outer end of said end-to-end shells, and (f) a plurality of bifurcated members whose legs extend at right angles to one another with one leg of each bifurcated member extending radially inwardly and being rigidly joined to a radially inwardly facing surface of said upper member and the other leg of each bifurcated member extending radially inwardly and being rigidly joined to one of the axially most distant surfaces of a pair of parallel plates.

2. The package of claim 1, further comprising at least one central cylindrical shell having a central bore extending axially therethrough and a divider plate rigidly joined to each end of each said central shell, each said central shell being positioned between said two outer shells.

3. The package of claim 1 or 2 further comprising a plurality of tie-bolts extending axially through tie-bolt holes provided in the shells.

4. The package of claim 1 or 2 wherein the central member is hollow and has a square cross-sectional configuration.

5. The package of claim 3 wherein each divider plate is welded to the respective shell end, the radially outer end of each side member is welded to the upper member and the radially inner end of each side member is welded to a radially outwardly facing surface of the central member and to the outer end of a respective outer shell, the axially extending portion of each tie member is welded to the respective radially extending portion of that tie member and the radially inner end of each radially extending portion is welded to the respective outer end of the outer shell, each leg of each bifurcated member is welded to the respective surface of said upper member or divider plate which it contacts.

6. The package of claim 5, wherein each weld by which the radially inner end of each side member is rigidly joined to the outer shell end extends radially inward from adjacent the outer circumference of said outer shell end and terminates prior to reaching the central member, and each weld by which the radially inner end of each side member is rigidly joined to the central member extends axially inwardly from the axially outermost extent of the side member and terminates prior to reaching the shell outer end.

7. The package of claim 5 wherein the radially inner end of each side member is truncated such that the junction of the central member and the shell end is not reached.

8. The package of claim 1 or 2, wherein each axial end of the upper horizontal frame member is welded to a radially extending portion of a right angle gusset and the radially outer end of each side frame member is welded to an axially extending portion of said right angle gusset and a planar gusset extends perpendicularly of and is welded to both the radially and axially extending portion of each right angle gusset, each said planar gusset including an aperture therethrough perpendicular to both the axial and radial directions of said shells and frame.

* * * * *